US010143875B2

(12) United States Patent
Moschel

(10) Patent No.: US 10,143,875 B2
(45) **Date of Patent: *Dec. 4, 2018**

(54) EXERCISE EQUIPMENT AND METHODS OF USING THE SAME

(71) Applicant: Michael Moschel, Astoria, NY (US)

(72) Inventor: Michael Moschel, Astoria, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/967,945

(22) Filed: Aug. 15, 2013

(65) Prior Publication Data

US 2014/0364281 A1 Dec. 11, 2014

Related U.S. Application Data

(60) Provisional application No. 61/831,903, filed on Jun. 6, 2013.

(51) Int. Cl.

| | |
|---|---|
| ***A63B 22/00*** | (2006.01) |
| ***A63B 21/00*** | (2006.01) |
| ***A63B 22/06*** | (2006.01) |
| ***A63B 21/078*** | (2006.01) |
| *A63B 21/072* | (2006.01) |

(52) U.S. Cl.

CPC ..... *A63B 21/00047* (2013.01); *A63B 21/078* (2013.01); *A63B 21/4031* (2015.10); *A63B 22/0005* (2015.10); *A63B 22/0012* (2013.01); *A63B 22/0605* (2013.01); *A63B 21/0724* (2013.01); *A63B 22/0694* (2013.01)

(58) Field of Classification Search

CPC ..... A63B 21/00047; A63B 22/0605; A63B 23/03516; A63B 23/03558; A63B 23/03575; A63B 21/078; A63B 21/4029; A63B 21/4031; A63B 23/12; A63B 23/035–23/03591; A63B 23/0476; A63B 22/0635; A63B 21/0783; A63B 2022/0652

USPC ..... 482/51, 56–62, 79, 80, 93, 94, 97, 104, 482/133, 138, 142

See application file for complete search history.

(56) References Cited

U.S. PATENT DOCUMENTS

| | | | | |
|---|---|---|---|---|
| 2,209,034 | A | 7/1940 | Paul | |
| 3,833,216 | A * | 9/1974 | Philbin | 482/64 |
| 3,964,742 | A | 6/1976 | Carnielli | |
| 4,333,644 | A | 6/1982 | Lambert, Jr. et al. | |
| 4,625,962 | A | 12/1986 | Street | |
| 4,765,616 | A | 8/1988 | Wolff | |
| 4,830,362 | A | 5/1989 | Bull | |

(Continued)

FOREIGN PATENT DOCUMENTS

| | | |
|---|---|---|
| CA | 2630430 | 11/2009 |
| KR | 1020120070239 | 6/2012 |
| WO | 9700031 | 1/1997 |

OTHER PUBLICATIONS

U.S. Appl. No. 61/831,903, filed Jun. 6, 2013.

(Continued)

*Primary Examiner* — Stephen R Crow

(57) ABSTRACT

A bench press includes a frame, a first portion of the frame configured to support a resistance load; a bench supported by the frame, the bench configured to provide a user access to the resistance load while the user is supported on the bench in an at least partially supine position; and a pair of movable foot pedals connected to a second portion of the frame and configured so that the user can engage the movable foot pedals while accessing the resistance load.

18 Claims, 5 Drawing Sheets

(56) References Cited

U.S. PATENT DOCUMENTS

| | | | | |
|---|---|---|---|---|
| 4,838,547 | A * | 6/1989 | Sterling | 482/128 |
| 4,842,269 | A | 6/1989 | Huang | |
| D305,677 | S | 1/1990 | Beistegui | |
| D308,085 | S | 5/1990 | Alberta | |
| 4,974,839 | A | 12/1990 | Cantor | |
| 4,974,840 | A * | 12/1990 | Welch | 482/133 |
| 4,976,426 | A * | 12/1990 | Szabo | A63B 21/00178 482/111 |
| 5,108,092 | A | 4/1992 | Hurst | |
| 5,145,479 | A | 9/1992 | Olschansky et al. | |
| 5,178,593 | A | 1/1993 | Roberts | |
| D342,299 | S | 12/1993 | Birrell et al. | |
| D343,878 | S | 2/1994 | Hughes | |
| 5,318,487 | A * | 6/1994 | Golen et al. | 482/5 |
| 5,405,305 | A | 4/1995 | Wilkinson et al. | |
| 5,496,236 | A | 3/1996 | Buonauito | |
| D372,283 | S | 7/1996 | Chen | |
| 5,569,128 | A | 10/1996 | Dalebout | |
| 5,580,341 | A | 12/1996 | Simonson | |
| 5,823,921 | A * | 10/1998 | Dawson | 482/104 |
| 5,941,803 | A | 8/1999 | Chamberlain et al. | |
| 5,971,898 | A | 10/1999 | Schoolfield | |
| 5,976,062 | A | 11/1999 | Toups | |
| 6,071,216 | A | 6/2000 | Giannelli et al. | |
| D427,652 | S | 7/2000 | Webber | |
| 6,090,021 | A * | 7/2000 | Flowers et al. | 482/104 |
| 6,254,516 | B1 | 7/2001 | Giannelli et al. | |
| 6,413,192 | B2 * | 7/2002 | Abelbeck | 482/57 |
| D462,730 | S | 9/2002 | Cormier | |
| 6,478,127 | B2 | 11/2002 | Fukushima | |
| 6,547,702 | B1 | 4/2003 | Heidecke | |
| 6,551,219 | B1 | 4/2003 | Brown | |
| 6,565,495 | B2 * | 5/2003 | Slattery | A63B 21/06 482/142 |
| 6,902,515 | B2 | 6/2005 | Howell et al. | |
| D526,368 | S | 8/2006 | Giger et al. | |
| D531,237 | S | 10/2006 | Giger et al. | |
| 7,285,077 | B1 * | 10/2007 | Marx | A63B 21/06 482/104 |
| 7,322,907 | B2 | 1/2008 | Bowser | |
| 7,513,853 | B1 | 4/2009 | Russ | |
| 7,524,272 | B2 | 4/2009 | Bruck et al. | |
| 7,662,070 | B1 | 2/2010 | Mann | |
| 7,695,411 | B2 | 4/2010 | Pandozy | |
| 7,717,833 | B1 | 5/2010 | Nelson et al. | |
| 7,740,563 | B2 | 6/2010 | Dalebout et al. | |
| 7,775,936 | B2 | 8/2010 | Wilkinson | |
| 7,874,971 | B2 | 1/2011 | Reyes | |
| D637,245 | S | 5/2011 | Huber et al. | |
| 7,985,167 | B2 | 7/2011 | Nizam | |
| 8,206,272 | B2 * | 6/2012 | Greene | 482/57 |
| 8,388,504 | B2 | 3/2013 | Ellis | |
| 8,523,743 | B1 | 9/2013 | Miles et al. | |
| D697,565 | S | 1/2014 | Giger et al. | |
| 8,696,526 | B1 * | 4/2014 | Dew | A63B 22/0605 482/57 |
| 8,821,354 | B1 * | 9/2014 | Tabahi | 482/62 |
| D727,444 | S | 4/2015 | Dixon | |
| 9,079,067 | B2 | 7/2015 | Huber et al. | |
| 9,233,277 | B1 * | 1/2016 | Krull | A63B 26/00 |
| 9,545,540 | B1 * | 1/2017 | Moschel | A63B 22/0046 |
| D783,741 | S * | 4/2017 | Moschel | D21/690 |
| D784,465 | S * | 4/2017 | Moschel | D21/690 |
| D785,107 | S * | 4/2017 | Moschel | D21/690 |
| D785,732 | S * | 5/2017 | Moschel | D21/690 |
| 9,878,201 | B1 * | 1/2018 | Moschel | A63B 22/0012 |
| 9,919,183 | B1 * | 3/2018 | Moschel | A63B 22/0605 |
| 2002/0035017 | A1 | 3/2002 | Pertegaz-Esteban | |
| 2004/0192522 | A1 * | 9/2004 | Hippensteel | 482/142 |
| 2005/0096196 | A1 | 5/2005 | Webber et al. | |
| 2005/0101463 | A1 | 5/2005 | Chen | |
| 2005/0277524 | A1 * | 12/2005 | Bae | 482/93 |
| 2006/0019804 | A1 * | 1/2006 | Young | 482/93 |
| 2006/0063650 | A1 | 3/2006 | Francis | |
| 2006/0116253 | A1 | 6/2006 | Nizam | |
| 2006/0189451 | A1 | 8/2006 | Nelson | |
| 2006/0264304 | A1 | 11/2006 | Habing | |
| 2007/0173384 | A1 | 7/2007 | Sechrest et al. | |
| 2008/0051274 | A1 * | 2/2008 | Greene | 482/142 |
| 2008/0318738 | A1 * | 12/2008 | Chen | 482/57 |
| 2009/0286658 | A1 | 11/2009 | James | |
| 2010/0035729 | A1 | 2/2010 | Pandozy | |
| 2010/0210425 | A1 * | 8/2010 | Bowser | 482/62 |
| 2011/0172064 | A1 * | 7/2011 | Cutler et al. | 482/63 |
| 2011/0245043 | A1 | 10/2011 | Mitchell | |
| 2014/0031173 | A1 | 1/2014 | Huang | |
| 2014/0031174 | A1 | 1/2014 | Huang | |
| 2014/0287883 | A1 | 9/2014 | Decca | |

OTHER PUBLICATIONS

U.S. Appl. No. 61/872,207, filed Aug. 30, 2013.

Photograph of prior art exercise machine. Accessed from World Wide Web on Sep. 20, 2013.

Declaration of Michael Moschel under 37 C.F.R. 1.132, filed in U.S. Appl. No. 14/104,664 dated Dec. 30, 2015.

Declaration of Michael Moschel under 37 C.F.R. 1.132, filed in U.S. Appl. No. 14/154,957 dated Feb. 8, 2016.

Sky presscycle by symmetry central, accessed online by USPTO [Nov. 8, 2016] http://www.symmetrycentral.com/.

Recumbent Bike Intervals + Arm Training, <https://www.youtube.com/watch?v=Z5_PqnKmcs4>, Nov. 2 2010.

Declaration of Michael Moschel under 37 C.F.R. 1.132, filed in U.S. Appl. No. 14/104,664 dated Jan. 17, 2017.

Declaration of Michael Moschel under 37 C.F.R. 1.132 filed in U.S. Appl. No. 14/961,134 dated Aug. 22, 2016.

* cited by examiner

EXERCISE EQUIPMENT AND METHODS OF USING THE SAME

CROSS-REFERENCE TO RELATED APPLICATION

This application claims the benefit of and priority to U.S. Provisional Patent Application No. 61/831,903, filed on Jun. 6, 2013, the entire contents of which are incorporated by reference herein.

FIELD

The present invention generally relates to physical exercise equipment and methods of using the same. In embodiments, the present invention generally relates to physical exercise equipment incorporating more than one movement.

SUMMARY

The present invention generally relates to an apparatus and/or method of using the same comprising a target exercise portion and a distraction exercise portion, wherein the target exercise portion and the distraction exercise portion are substantially biomechanically isolated from each other.

A bench press according to an exemplary embodiment of the present invention comprises: a frame, a first portion of the frame configured to support a resistance load; a bench supported by the frame, the bench configured to provide a user access to the resistance load while the user is supported on the bench in an at least partially supine position; and a pair of movable foot pedals connected to a second portion of the frame and configured so that the user can engage the movable foot pedals while accessing the resistance load.

In an exemplary embodiment, the bench comprises a back support and a seat support.

In an exemplary embodiment, the back support is pivotably coupled with the seat support.

In an exemplary embodiment, the back support is disposed at an angle of about 90 degrees with respect to the seat support.

In an exemplary embodiment, the back support is disposed at an angle of about 180 degrees with respect to the seat support.

In an exemplary embodiment, the back support is disposed at an oblique angle with respect to the seat support.

In an exemplary embodiment, the back support is disposed at an angle of about 40 degrees with respect to the seat support.

In an exemplary embodiment, the resistance load is one of a barbell, a dumbbell, and a kettlebell.

In an exemplary embodiment, the movable foot pedals are releasably coupled with the frame.

In an exemplary embodiment, the movable foot pedals are adjustable relative to the bench.

A method of physical exercise training according to an exemplary embodiment of the present invention comprises: providing a physical exercise apparatus comprising: a frame, a first portion of the frame configured to support a resistance load; a bench supported by the frame; and a pair of movable foot pedals connected to a second portion of the frame; positioning at least a portion of a body of a user in an at least partially supine position on the bench; accessing the resistance load by the user in the at least partially supine position; engaging the movable foot pedals by respective feet of the user in the at least partially supine position; and simultaneously lifting by the user the resistance load and cycling by the user the movable foot pedals with the user in the at least partially supine position.

In an exemplary embodiment, providing the physical exercise apparatus includes providing the bench with a back support and a seat support.

In an exemplary embodiment, providing the physical exercise apparatus includes providing the bench with the back support pivotably coupled with the seat support.

In an exemplary embodiment, providing the physical exercise apparatus includes providing the bench with the back support disposed at an angle of about 90 degrees with respect to the seat support.

In an exemplary embodiment, providing the physical exercise apparatus includes providing the bench with the back support disposed at an angle of about 180 degrees with respect to the seat support.

In an exemplary embodiment, providing the physical exercise apparatus includes providing the bench with the back support disposed at an oblique angle with respect to the seat support.

In an exemplary embodiment, providing the physical exercise apparatus includes providing the resistance load being one of: a barbell, a dumbbell, and a kettlebell.

A method of physical exercise training according to an exemplary embodiment of the present invention comprises: providing a physical exercise apparatus comprising: a frame, a first portion of the frame configured to support a resistance load; a bench supported by the frame; and a pair of movable foot pedals connected to a second portion of the frame; positioning at least a portion of a body of a user in a supine position on the bench; accessing the resistance load by the user in the supine position; engaging the movable foot pedals by respective feet of the user in the supine position; and simultaneously lifting by the user the resistance load and cycling by the user the movable foot pedals with the user in the supine position.

In an exemplary embodiment, providing the physical exercise apparatus includes providing the resistance load being one of: a barbell, a dumbbell, and a kettlebell.

A method of physical exercise according to an exemplary embodiment of the present invention comprises: simultaneously accessing a resistance load and engaging a pair of movable foot pedals while disposed on a bench in an at least partially supine position, wherein the resistance load is supported by a first portion of a frame, and the pair of movable foot pedals are connected to a second portion of the frame.

BRIEF DESCRIPTION OF THE DRAWINGS

Various exemplary embodiments of this invention will be described in detail, with reference to the following figures, wherein.

DETAILED DESCRIPTION OF EMBODIMENTS

The present invention is generally directed to physical exercise equipment and associated methods of use. The present invention generally relates to an apparatus and/or method of using the same comprising a target exercise portion and a distraction exercise portion, wherein the target exercise portion and the distraction exercise portion are substantially biomechanically isolated from each other.

Exemplary embodiments of the present invention are directed to exercise equipment apparatuses that include a first exercise equipment portion configured to provide resistance to one part of the body, e.g., a portion of the upper or lower body, and a second exercise equipment portion configured to provide resistance to another part of the body, e.g., a portion of the other of the upper or lower body. The disclosed exercise equipment apparatuses may be configured to distract, e.g., generate neuromuscular signals, work, load, or otherwise engage at least one portion of a user's body to inhibit another, target portion of the user's body from being leveraged or otherwise assisted by the distracted portion of the user's body. This arrangement of movements may facilitate increased resistance loading of the target portion of the user's body. In embodiments, a distracting exercise may incorporate substantial resistance, e.g., a strength training exercise. In embodiments, a distracting exercise may be configured primarily or exclusively for strength training, e.g., a distracting exercise may provide little or no cardiovascular training. In embodiments, a cycling motion of a user's legs includes flexion and/or extension of the user's leg at the knee. In preferred embodiments, a distracting exercise may be primarily directed toward engaging a user's muscles such that the engaged muscles may not be leveraged against a target portion of the user's body. In embodiments, distraction of one portion of a user's body may facilitate the engagement of deep, e.g., sub-superficial, muscles, ligaments and/or tendons of a target portion of the user's body. In embodiments, the distraction of one portion of the user's body may tend to position at least the target portion of the user's body in a manner such that the user is discouraged from favoring and/or leveraging one portion of a target muscle group against another portion of the target muscle group.

Figure 1A:
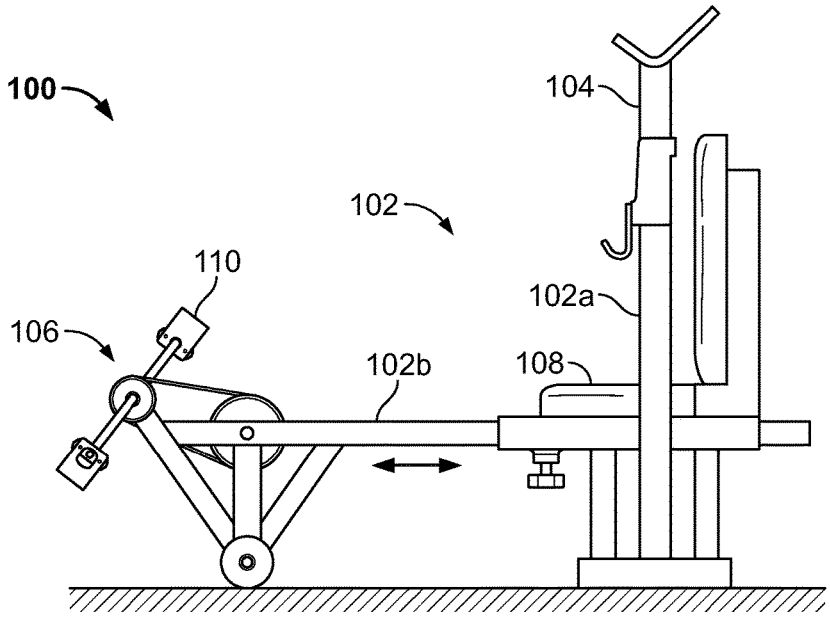
FIG. 1A is a side view of a physical exercise equipment apparatus according to an exemplary embodiment of the present disclosure.

Referring initially to FIG. 1A, an exercise equipment apparatus, e.g., a bench or shoulder press, according to an exemplary embodiment of the present disclosure is generally designated by reference 100. Exercise equipment apparatus 100 may include a frame 102 that may include a vertical frame portion 102*a* and a horizontal frame portion 102*b*. Exercise equipment apparatus 100 may include an upper body portion 104, a lower body portion 106, and a seating portion, e.g., a bench 108. Bench 108 may comprise a back support disposed at an orthogonal angle, e.g., about 90 degrees, with respect to a seat support. Bench 108 may be supported by the frame 102. In embodiments, the components of upper body portion 104, lower body portion 106, and/or bench 108 may be integrally formed with or separable from frame 102. In embodiments, bench 108 may be separate from the frame 102, e.g., a wheeled bench that may be positioned along a portion of frame 102. Upper body portion 104 may comprise a portion of the frame 102 and be configured to support a resistance load, e.g., a barbell coupled with weight plates. In embodiments, a resistance load may be, e.g., a dumbbell, kettlebell, resistance band, or other free weight. Lower body portion 106 may comprise movable foot pedals 110 attached, e.g., connected, to the frame 102 for engagement by a portion of the user's lower body, e.g., feet and legs.

In use, a user may position his or her body in an at least partially supine position, e.g., seated, on the bench 108 and access, e.g., grasp, the barbell mounted on the frame 102 (not shown). Simultaneously, the user may raise, e.g., lift or press, the barbell overhead and engage the movable foot pedals 110 with his or her legs and feet in a cycling motion from the at least partially supine position (not shown). The cycling motion of the legs may distract, e.g., substantially biomechanically isolate, the muscles of the lower body such that increased loading is experienced by, e.g., the deltoids or other regions of the upper body, by the overhead pressing of the barbell (not shown). In this manner, a user may be inhibited from using the muscles of the lower body to cheat or leverage, e.g., assist, the upper body of the user in performing the overhead press of the barbell.

In embodiments, the distraction of the lower body caused by the cycling motion of a user's legs may place the user in a position that facilitates substantially even, e.g., symmetric with respect to an axial midline of the body, resistive loading across a target muscle group. The distraction of the lower body may position the user to engage the barbell in a manner that discourages the user from, e.g., twisting, jerking, and/or shifting when using the exercise equipment apparatus 100. In this manner, exercise equipment apparatus 100 may be configured to position a user, via a distraction exercise, such that a target muscle group receives an even resistive loading to, e.g., minimize, prevent, and/or improve muscular imbalances, and/or encourage symmetrical development of muscles with respect to an axial midline of the body, within target muscle groups.

Figure 1B:
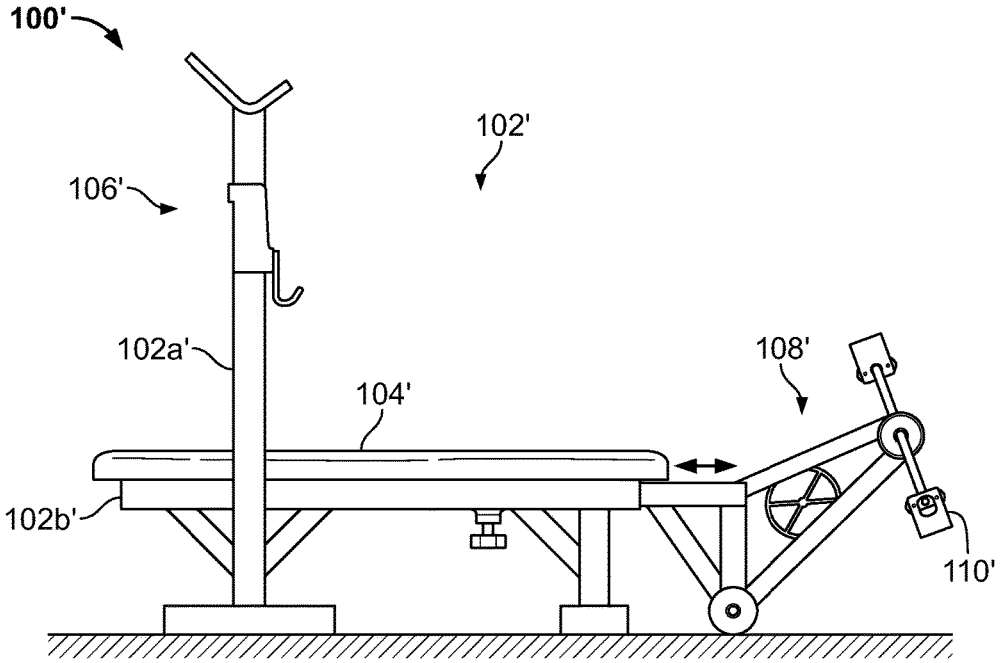
FIG. 1B is a side view of an exemplary embodiment of the present disclosure.
Figure 1C:
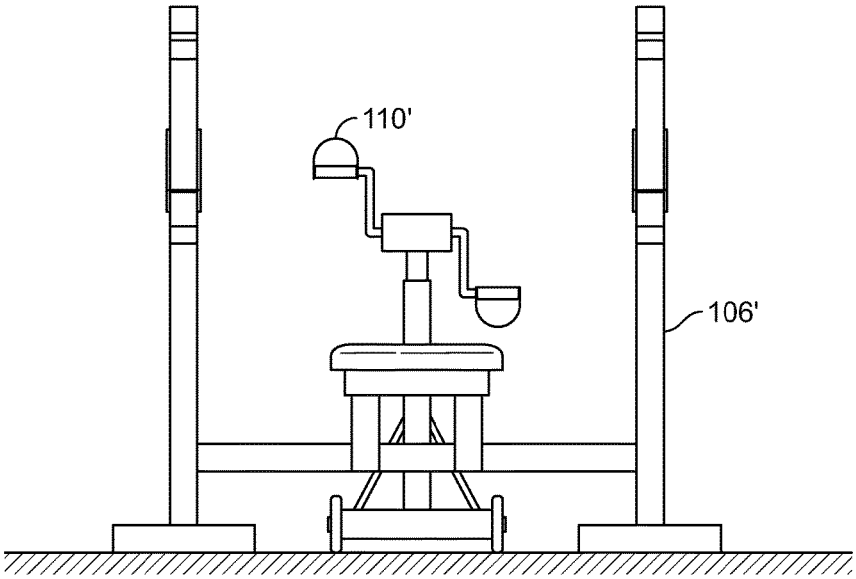
FIG. 1C is a rear side view of the physical exercise equipment apparatus shown in FIG. 1B.

Turning to FIGS. 1B and 1C, an exercise equipment apparatus, e.g., a bench press according to an exemplary embodiment of the present disclosure is generally designated by reference 100'. Exercise equipment apparatus 100' may include a frame 102' that may include a vertical portion 102*a*' and a horizontal portion 102*b*'. Exercise equipment apparatus 100' may include a seating portion, e.g., a bench 104' supported by frame 102', an upper body portion 106', and a lower body portion 108'. In embodiments, bench 104', upper body portion 106', and/or lower body portion 108' may be integrally formed with or separable from the frame 102'. Bench 104' may be configured as, e.g., a flat bench disposed orthogonal to the vertical portion 102*a*' of frame 102'. Bench 104' may include a back support and a seat support. In embodiments, exercise equipment apparatus 100' may incorporate a bench 104' that is separate from the frame 102', e.g., a wheeled bench.

Upper body portion 106' may comprise a portion of frame 102' configured to support a resistance load, e.g., a barbell coupled with weight plates (not shown). Lower body portion 108' may comprise movable foot pedals 110' attached, e.g., connected, to frame 102' for engagement by a portion of the user's lower body, e.g., feet and legs.

In use, a user may position his or her body in a supine or at least partially supine, e.g., seated or lying face-up, position on the bench 104' and access, e.g., grasp, the barbell mounted on the of the frame 102' (not shown). Simultaneously, the user may raise, e.g., lift or press, the barbell overhead and engage the movable foot pedals 110' with his or her legs and feet in a cycling motion from the at least partially supine position (not shown). The cycling motion of the legs may distract, e.g., substantially biomechanically isolate, the muscles of the lower body such that increased loading is experienced by, e.g., the pectoralis major muscles or other regions of the upper body, by the overhead pressing of the barbell (not shown). In this manner, a user may be inhibited from using the muscles of the lower body to cheat or leverage, e.g., assist, the upper body of the user in performing the chest press of the barbell.

In embodiments, the distraction of the lower body caused by the cycling motion of a user's legs may place the user in a position that facilitates substantially even, e.g., symmetric with respect to an axial midline of the body, resistive loading across a target muscle group. The distraction of the lower body may position the user to engage the barbell in a manner that discourages the user from, e.g., twisting, jerking, and/or shifting when using the exercise equipment apparatus 100'. In this manner, exercise equipment apparatus 100' may be configured to position a user, via a distraction exercise, such that a target muscle group receives an even resistive loading to, e.g., minimize, prevent, and/or improve muscular imbalances, and/or encourage symmetrical development of muscles with respect to an axial midline of the body, within target muscle groups.

Figure 1D:
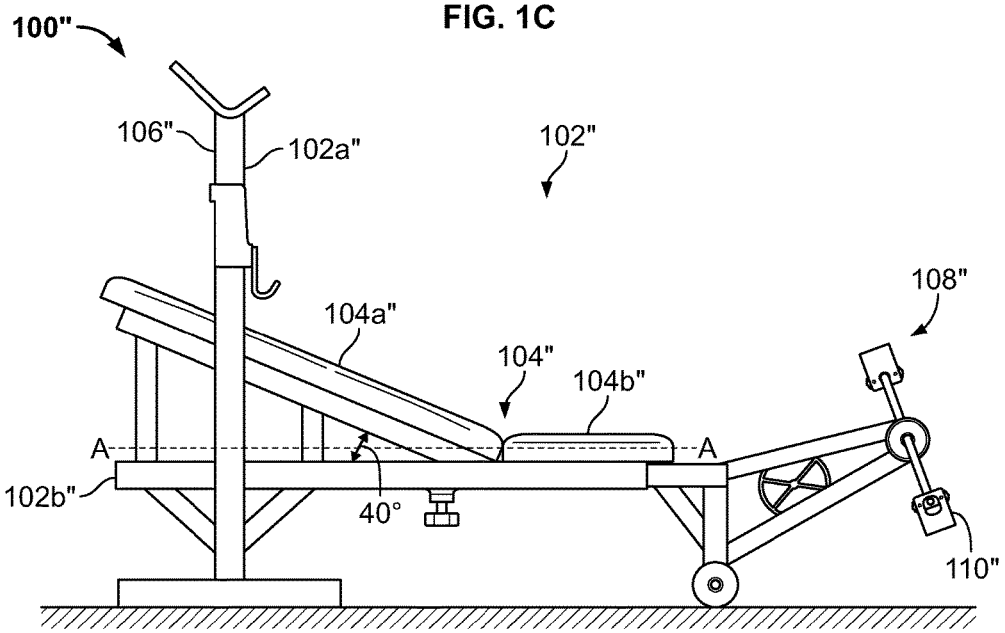
FIG. 1D is a side view of a physical exercise equipment apparatus according to an exemplary embodiment of the present disclosure.

Turning to FIG. 1D, an exercise equipment apparatus, e.g., a bench press, according to an exemplary embodiment of the present disclosure is generally designated by reference 100". Exercise equipment apparatus 100" may include a frame 102" that may include a vertical portion 102*a*" and a horizontal portion 102*b*". Exercise equipment apparatus 100" may include a seating portion, e.g., a bench 104" supported by frame 102", an upper body portion 106", and a lower body portion 108". In embodiments, components of bench 104", upper body portion 106", and/or lower body portion 108" may be integrally formed with or separable from frame 102". Bench 104" may incorporate a back support 104*a*" and a seat support 104*b*". Seat support 104*b*" may have a substantially horizontal configuration, e.g., seat support 104*b*" may be level with the ground or flooring beneath exercise equipment apparatus 100". Back support 104*a*" may be disposed at an oblique angle with respect to the seat support 104*b*", e.g., an angle of about 40 degrees with respect to a reference line A drawn through the seat support 104*b*". In embodiments, back support 104*a*" may be disposed at a fixed angle with respect to seat support 104*b*". In embodiments, back support 104*a*" may be adjustable, e.g., hingably or pivotably coupled, with seat support 104*b*" such that back support 104*a*" may be moved through a range of angles with respect to seat support 104*b*". In embodiments, back support 104*a*" may be fixedly or adjustably disposed at a range of angles with respect to seat support 104*b*" e.g., between and including about 180 degrees and about 90 degrees. Upper body portion 106" may comprise a portion of frame 102' configured to support a resistance load, e.g., a barbell coupled with weight plates. Lower body portion 108" may comprise movable foot pedals 110" attached, e.g., connected, to a portion of frame 102' for engagement by a portion of the user's lower body, e.g., feet and legs.

In use, a user may position his or her body in a supine or at least partially supine, e.g., seated or face-up, position on the bench 104" and access, e.g., grasp, the barbell mounted on the frame 102" (not shown). Simultaneously, the user may raise, e.g., lift or press, the barbell overhead and engage the movable foot pedals 110" with his or her legs and feet in a cycling motion from the at least partially supine position (not shown). The cycling motion of the legs may distract, e.g., substantially biomechanically isolate, the muscles of the lower body such that increased loading is experienced by, e.g., the deltoids or other regions of the upper body, by the overhead pressing of the barbell (not shown). In this manner, a user may be inhibited from using the muscles of the lower body to cheat or leverage, e.g., assist, the upper body of the user in performing the overhead press of the barbell.

In embodiments, the distraction of the lower body caused by the cycling motion of a user's legs may place the user in a position that facilitates substantially even, e.g., symmetric with respect to an axial midline of the body, resistive loading across a target muscle group. The distraction of the lower body may position the user to engage the barbell in a manner that discourages the user from, e.g., twisting, jerking, and/or shifting when using the exercise equipment apparatus 100". In this manner, exercise equipment apparatus 100" may be configured to position a user, via a distraction exercise, such that a target muscle group receives an even resistive loading to, e.g., minimize, prevent, and/or improve muscular imbalances, and/or encourage symmetrical development of muscles with respect to an axial midline of the body, within target muscle groups.

Figure 2A:
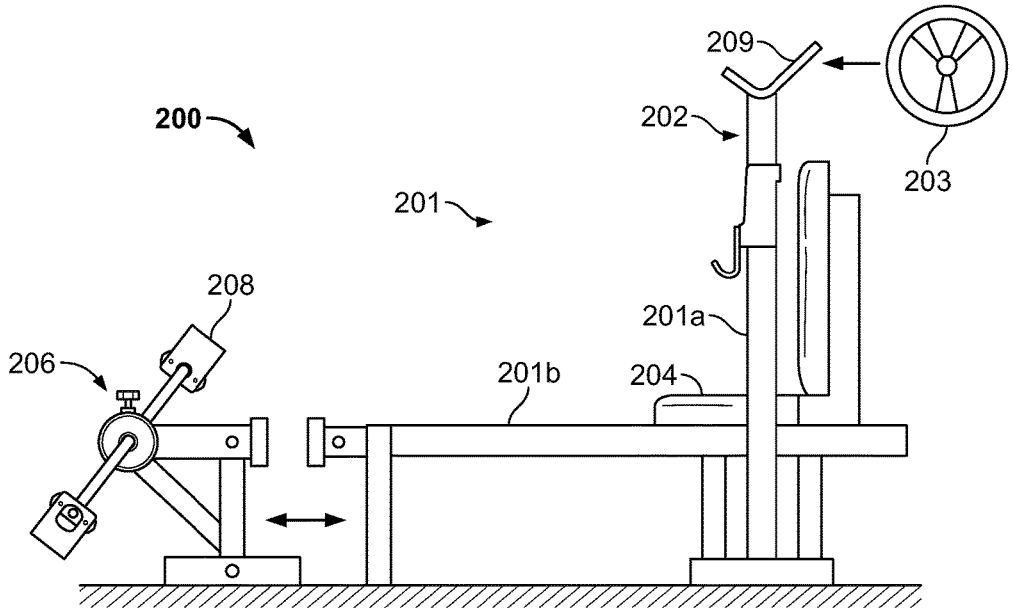
FIG. 2A is a side, parts-separated view of a physical exercise equipment apparatus according to an exemplary embodiment of the present disclosure.
Figure 2B:
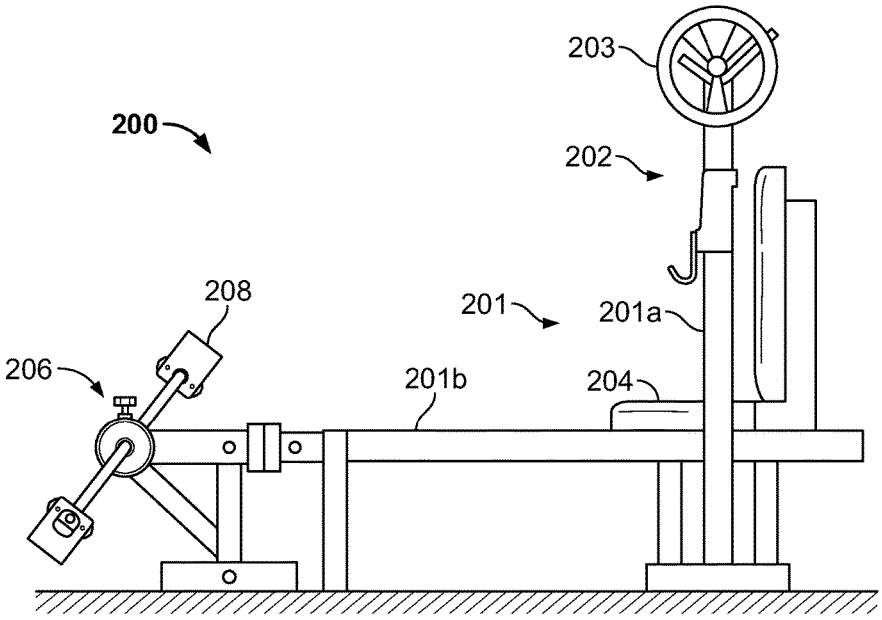
FIG. 2B is a side, assembled view of the physical exercise equipment apparatus of FIG. 2A.

In embodiments, an exercise equipment apparatus may be comprised of a pre-existing exercise equipment component that is modified, e.g., retrofitted. Turning to FIGS. 2A and 2B, an exercise equipment apparatus, e.g., a bench press, according to an exemplary embodiment of the present disclosure is generally designated 200. Exercise equipment apparatus 200 may comprise a frame 201 that may include a vertical portion 201*a* and a horizontal portion 201*b*. Exercise equipment apparatus 200 may include an upper body portion 202, a seating portion, e.g., a bench 204 supported by frame 201, and a lower body portion 206. Bench 204 may comprise a back support and a seat support. Upper body portion 202 may comprise a portion of frame 201 configured to support a resistance load, e.g., a barbell 203. In embodiments, frame 201 may be configured to support another resistance load, e.g., a dumbbell, kettlebell, resistance band, or other free weight. Lower body portion 206 may comprise structure for continuous engagement by a user, e.g., movable foot pedals 208. Movable foot pedals 208 may be adjustable, e.g., disposed along an extendable and/or retractable portion with respect to the bench 204, such that movable foot pedals 208 may be positioned relative to the bench 204 to accommodate a user's size. Lower body portion 206 may also include complementary structure to movable foot pedals 208, e.g., an axle, gear train, or the like. In embodiments, lower body portion 206 may comprise different structure.

Frame 201 may be provided separately or together with barbell 203 and/or movable foot pedals 208. Barbell 203 may rest on a weight support 209, e.g., a pair of racks or hooks, on a portion of frame 201. Movable foot pedals 208 may be coupled with a section of frame 201 in any suitable manner, e.g., soldering, welding, fasteners such as bolts or screws, straps, or interlocking features, to name a few. In this manner, movable foot pedals 208 may be retrofitted, e.g., attached or connected after an initial manufacture, to pre-existing exercise equipment apparatuses. In embodiments, movable foot pedals 208 may be supported by an independent frame.

In use, a user may assemble the frame 201, barbell 203, bench 204, and movable foot pedals 208 to form exercise equipment apparatus 200. A user may position his or her body in a supine or at least partially supine position, e.g., seated or lying face-up, on the bench 204 and access, e.g., grasp, the barbell 203 mounted on the frame 201. Simultaneously, the user may raise, e.g., lift or press, the barbell 203 overhead and engage the movable foot pedals 208 with his or her legs and feet in a cycling motion from the at least partially supine position (not shown). The cycling motion of the legs may distract, e.g., substantially biomechanically isolate, the muscles of the lower body such that increased loading is experienced by, e.g., the deltoids or other regions of the upper body, by the overhead pressing of barbell 203 (not shown). In this manner, a user is inhibited from using the muscles of the lower body to cheat or leverage, e.g., assist, the upper body of the user in performing the overhead press of the barbell 203.

In embodiments, the distraction of the lower body caused by the cycling motion of a user's legs may place the user in a position that facilitates substantially even, e.g., symmetric with respect to an axial midline of the body, resistive loading across a target muscle group. The distraction of the lower body may position the user to engage the barbell 203 in a manner that discourages the user from, e.g., twisting, jerking, and/or shifting when using the exercise equipment apparatus 200. In this manner, exercise equipment apparatus 200 may be configured to position a user, via a distraction exercise, such that a target muscle group receives an even resistive loading to, e.g., minimize, prevent, and/or improve muscular imbalances, and/or encourage symmetrical development of muscles with respect to an axial midline of the body, within target muscle groups.

Figure 2C:
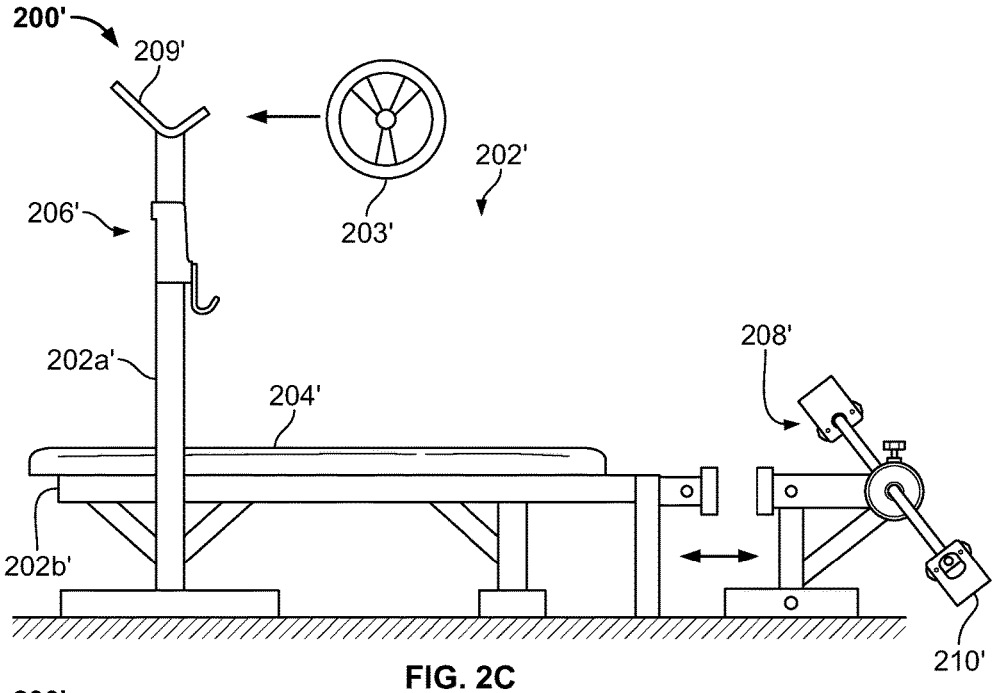
FIG. 2C is a side, parts-separated view of a physical exercise equipment apparatus according to an exemplary embodiment of the present disclosure.
Figure 2D:
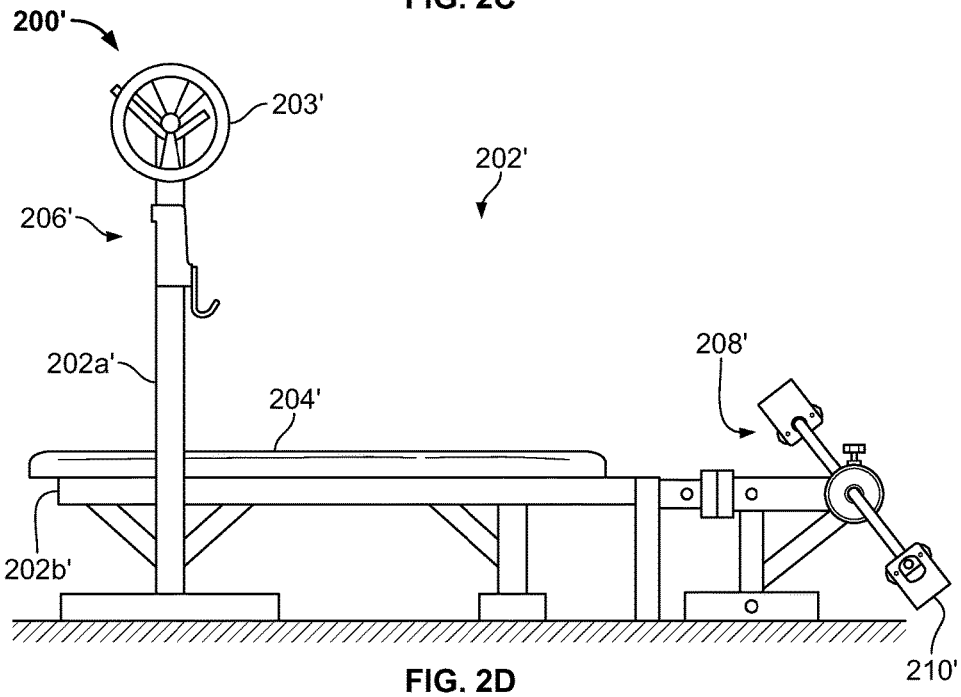
FIG. 2D is a side, assembled view of the physical exercise equipment apparatus of FIG. 2C.

Turning to FIGS. 2C, and 2D, an exercise equipment apparatus, e.g., a bench press, according to an exemplary embodiment of the present disclosure is generally designated by reference 200'. Exercise equipment apparatus 200' may include a frame 202' that may have a vertical portion 202*a*' and a horizontal portion 202*b*'. Exercise equipment apparatus 200' may include a seating portion, e.g., a bench 204' supported by frame 202', an upper body portion 206', and a lower body portion 208'. Components of bench 204', upper body portion 206', and/or lower body portion 208' may be separable or integrally formed with frame 202'. Bench 204' may include a back support and a seat support disposed at an angle of, e.g., about 180 degrees relative to one another.

Upper body portion 206' may comprise a portion of frame 202' configured to support a resistance load, e.g., a barbell 203' coupled with weight plates. Barbell 203' may be loaded onto a weight support 209', e.g., pair of racks or hooks, on the frame 202'.

Lower body portion 208' may comprise structure for continuous engagement by a user, e.g., movable foot pedals 210'. Movable foot pedals 210' may be adjustable, e.g., disposed along an extendable and/or retractable portion with respect to the bench 204', such that movable foot pedals 210' may be positioned relative to the bench 204' to accommodate a user's size. Lower body portion 208' may also include complementary structure to movable foot pedals 210', e.g., an axle, gear train, or the like. In embodiments, lower body portion 208' may comprise different structure. Movable foot pedals 210' may be coupled with the bench 204', e.g., a section of the frame 202, in any suitable manner, e.g., welding, soldering, fasteners such as bolts or screws, or straps, to name a few. In this manner, movable foot pedals 210' may be retrofitted, e.g., attached or connected after an initial manufacture, to pre-existing exercise equipment apparatuses. In embodiments, movable foot pedals 210' may be supported by an independent frame.

In use, a user may assemble the frame 202', barbell 203', bench 204', and movable foot pedals 210' to form exercise equipment apparatus 200'. A user may position his or her body in a supine or at least partially supine position, e.g., seated or lying face-up, on the bench 204' and access, e.g., grasp, the barbell 203'. Simultaneously, the user may raise, e.g., lift or press, the barbell 203' overhead and engage the movable foot pedals 210' with his or her legs and feet in a cycling motion from the at least partially supine position (not shown). The cycling motion of the legs may distract, e.g., substantially biomechanically isolate, the muscles of the lower body such that increased loading is experienced by, e.g., the pectoralis major muscles or other regions of the upper body, by the overhead pressing of the barbell 203' (not shown). In this manner, a user may be inhibited from using the muscles of the lower body to cheat or leverage, e.g., assist, the upper body of the user in performing the chest press of the barbell 203'.

In embodiments, the distraction of the lower body caused by the cycling motion of a user's legs and feet may place the user in a position that facilitates substantially even, e.g., symmetric with respect to an axial midline of the body, resistive loading across a target muscle group. The distraction of the lower body may position the user to engage the barbell 203' in a manner that discourages the user from, e.g., twisting, jerking, and/or shifting when using the exercise equipment apparatus 200'. In this manner, exercise equipment apparatus 200' may be configured to position a user, via a distraction exercise, such that a target muscle group receives an even resistive loading to, e.g., minimize, prevent, and/or improve muscular imbalances, and/or encourage symmetrical development of muscles with respect to an axial midline of the body, within target muscle groups.

Figure 2E:
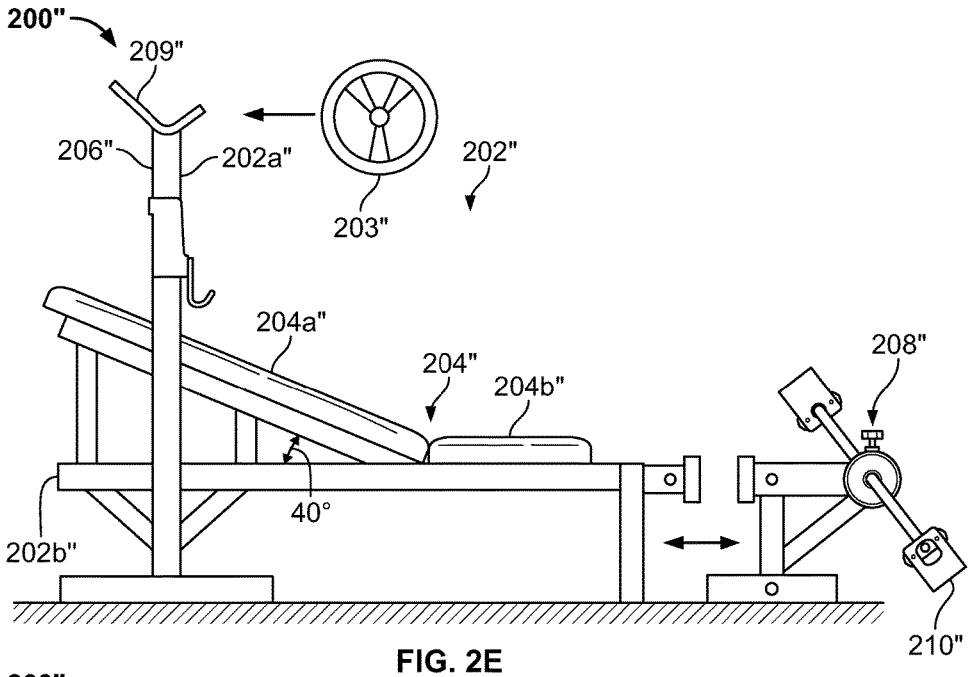
FIG. 2E is a side, parts-separated view of a physical exercise equipment apparatus according to an exemplary embodiment of the present disclosure.
Figure 2F:
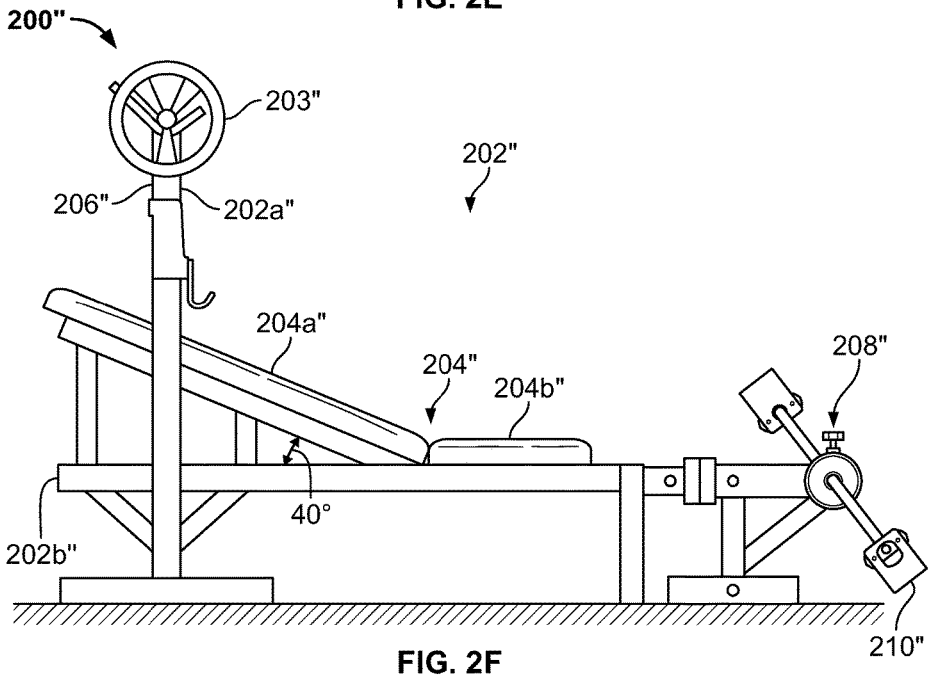
FIG. 2F is a side, assembled view of the physical exercise equipment apparatus of FIG. 2E.

Turning to FIGS. 2E and 2F, an exercise equipment apparatus, e.g., a bench press, according to an exemplary embodiment of the present disclosure is generally designated by reference 200". Exercise equipment apparatus 200" may include a frame 202" that may have a vertical portion 202*a*" and a substantially horizontal portion 202*b*". Exercise equipment apparatus 200" may include a seating portion, e.g., bench 204" supported by frame 202", an upper body portion 206", and a lower body portion 208". Components of bench 204", upper body portion 206", and/or lower body portion 208" may be separable from or integrally formed with the frame 202". Bench 204" may incorporate a back support 204*a*" and a seat support 204*b*". Seat support 204*b*" may have a substantially horizontal configuration, e.g., seat support 204*b*" may be level with the ground or flooring beneath exercise equipment apparatus 200". Back support 204*a*" may be disposed at an oblique angle with respect to the seat support 204*b*", e.g., an angle of about 40 degrees with respect to the horizontal portion 202*b*" of frame 202". In embodiments, back support 204*a*" may be disposed at a fixed angle with respect to seat support 204*b*". In embodiments, back support 204*a*" may be adjustable, e.g., hingably or pivotably coupled, with seat support 204*b*" such that back support 204*a*" may be moved through a range of angles with respect to seat support 204*b*". Back support 204*a*" may be disposed at a range of angles with respect to seat support 204*b*", e.g., between and including about 180 degrees and about 90 degrees.

Upper body portion 206" may comprise a portion of frame 202" configured to support a resistance load, e.g., a barbell 203" coupled with weight plates. Barbell 203" may be loaded onto a weight support 209", e.g., a pair of racks or hooks, on the frame 202".

Lower body portion 208" may comprise structure for continuous engagement by a user, e.g., movable foot pedals 210". Movable foot pedals 210" may be adjustable, e.g., disposed along an extendable and/or retractable portion with respect to the bench 204", such that movable foot pedals 210" may be positioned relative to the bench 204" to accommodate a user's size. Lower body portion 208" may also include complementary structure to movable foot pedals 210", e.g., an axle, gear train, or the like. In embodiments, lower body portion 208" may comprise different structure. Movable foot pedals 210" may be coupled with a section of the frame 202" in any suitable manner, e.g., welding, soldering, fasteners such as bolts or screws, straps, or interlocking features, to name a few. In this manner, movable foot pedals 210" may be retrofitted, e.g., attached or connected after an initial manufacture, to pre-existing exercise equipment apparatuses. In embodiments, movable foot pedals 210" may be supported by an independent frame.

In use, a user may assemble the frame 202", barbell 203", bench 204", and movable foot pedals 210" to form exercise equipment apparatus 200". The user may raise, e.g., lift or press, the barbell 203" overhead and engage the movable foot pedals 210" with his or her legs and feet in a cycling motion from the at least partially supine position (not shown). The cycling motion of the legs may distract, e.g., substantially biomechanically isolate, the muscles of the lower body such that increased loading is experienced by, e.g., the deltoids or other regions of the upper body, by the overhead pressing of the barbell 203". In this manner, a user may be inhibited from using the muscles of the lower body to cheat or leverage, e.g., assist, the upper body of the user in performing the overhead press of the barbell 203".

In embodiments, the distraction of the lower body caused by the cycling motion of a user's legs may place the user in a position that facilitates substantially even, e.g., symmetric with respect to an axial midline of the body, resistive loading across a target muscle group. The distraction of the lower body may position the user to engage the barbell 203" in a manner that discourages the user from, e.g., twisting, jerking, and/or shifting when using the exercise equipment apparatus 200". In this manner, exercise equipment apparatus 200" may be configured to position a user, via a distraction exercise, such that a target muscle group receives an even resistive loading to, e.g., minimize, prevent, and/or improve muscular imbalances, and/or encourage symmetrical development of muscles with respect to an axial midline of the body, within target muscle groups.

While this invention has been described in conjunction with the exemplary embodiments outlined above, it is evident that many alternatives, modifications and variations will be apparent to those skilled in the art. In particular, the frame, seating, and weight configurations disclosed above may be varied to suit the particular needs of the user, e.g., a modular or monolithically formed frame design, and resistance loads being configured as stacked or free weights, or resistance bands. Accordingly, the exemplary embodiments of the invention, as set forth above, are intended to be illustrative, not limiting. Various changes may be made without departing from the spirit and scope of the invention.

What is claimed is:

1. A method of physical exercise training, comprising:

(a) providing a physical exercise apparatus comprising:

(i) a frame, a first portion of the frame configured to support a resistance load associated with a target exercise comprising an upper body, weight lifting exercise that is targeted to engaging deltoid muscles in the user's upper body and to achieving abalanced muscular development of the deltoid muscles, wherein the first portion of the frame comprises a weight support for the resistance load;

(ii) a bench, comprising a back support, supported by the frame and configured so that a user performs the upper body, weight lifting exercise thereon using the resistance load; wherein the weight support for the resistance load is located in front of at least a portion of the back support and is configured so the user can access the resistance load for weight lifting; and (iii) a pair of movable foot pedals connected to a second portion of the frame but not connected to the resistance load so that the resistance load that is associated with the target exercise is not applied to the pair of movable foot pedals, and configured so that a user pedaling the pair of movable foot pedals is capable of simultaneously performing the upper body, weight lifting exercise, (b) positioning at least a portion of a body of a user in a seated position on the bench with the user's feet on the movable foot pedals;

(c) performing, by the user, the target exercise with the upper body of the user to engage the deltoid muscles, comprising lifting weight using the resistance load from the weight support when the user is in the seated position on the bench; and (d) while performing the target exercise of lifting weight with deltoid muscles of the upper body, simultaneously performing a distracting exercise that engages muscles of the lower body of the user with a physical distraction to inhibit the muscles of the lower body from assisting the user's deltoid muscles of the upper body in the target exercise, the distracting exercise comprising performing the pedaling in a cycling motion with the movable foot pedals by respective feet of the user in the seated position on the bench to distract the user so that the user more deeply engages the deltoid muscles of the user's upper body with the target exercise.

2. The method of claim 1, wherein providing the physical exercise apparatus includes providing the bench with the back support and a seat support.

3. The method of claim 2, wherein providing the physical exercise apparatus includes providing the bench with the back support pivotably coupled with the seat support.

4. The method of claim 2, wherein providing the physical exercise apparatus includes providing the bench with the back support disposed at an angle of about 90 degrees with respect to the seat support.

5. The method of claim 2, wherein providing the physical exercise apparatus includes providing the bench with the back support disposed at an oblique angle with respect to the seat support.

6. The method of claim 2, wherein providing the physical exercise apparatus includes providing the resistance load being one of: a barbell, a dumbbell, and a kettlebell.

7. A method of physical exercise training, comprising:

(a) providing a physical exercise apparatus comprising:

(i) a frame, a first portion of the frame configured to support a resistance load associated with a target exercise comprising an upper body, weight-lifting exercise that is targeted to engaging pectoralis muscles in the user's upper body and to achieving a balanced muscular development of the pectoralis muscles;

(ii) a bench supported by the frame and configured so that a user performs the upper body, weight lifting exercise thereon using the resistance load; and (iii) a pair of movable foot pedals connected to a second portion of the frame, but not connected to the resistance load so that the resistance load that is associated with the target exercise is not applied to the pair of movable foot pedals, and configured so that a user pedaling the pair of movable foot pedals is capable of simultaneously performing the upper body, weight lifting exercise, wherein the movable foot pedals are positioned above a height of the bench and wherein the movable foot pedals are adjustable by extension away from or retraction toward the bench:—:—

(b) positioning at least a portion of a body of a user in a supine position on the bench such that a user is lying on the bench face up with the user's back positioned substantially horizontally on the bench with the user's feet on the movable foot pedals with the movable foot pedals adjusted to be extended away from or retracted toward the bench;

(c) performing, by the user, the target exercise with the upper body of the user to engage the pectoralis muscles, comprising lifting weight using the resistance load when the user is in the supine position on the bench; and (d) while performing the target exercise with the upper body of lifting weight with pectoralis muscles of the upper body, simultaneously performing a distracting exercise that engages muscles of the lower body of the user with a physical distraction to inhibit the muscles of the lower body from assisting the user's pectoralis muscles of the upper body in the target exercise, the distracting exercise comprising performing the pedaling in a cycling motion with the movable foot pedals by respective feet of the user in the supine position on the bench to distract the user so that the user more deeply engages the pectoralis muscles of the user's upper body with the target exercise.

8. The method of claim 7, wherein providing the physical exercise apparatus includes providing the resistance load being one of: a barbell, a dumbbell, and a kettlebell.

9. A method of physical exercise training, comprising:

(a) providing a physical exercise apparatus comprising:

(i) a frame, a first portion of the frame configured to support a resistance load associated with a target exercise comprising an upper body, weight lifting exercise that is targeted to engaging deltoid muscles in the user's upper body and to achieving abalanced muscular development of the deltoid muscles, wherein the first portion of the frame comprises a weight support for the resistance load;

(ii) a bench, comprising a back support, supported by the frame and configured so that a user performs the upper body, weight lifting exercise thereon using the resistance load; wherein the weight support for the resistance load is located in front of at least a portion of the back support and is configured so the user can access the resistance load for weight lifting; and (iii) a pair of movable foot pedals connected to a second portion of the frame but not connected to the resistance load so that the resistance load that is associated with the target exercise is not applied to the pair of movable foot pedals, and configured so that a user pedaling the pair of movable foot pedals is capable of simultaneously performing the upper body, weight lifting exercise, (b) positioning at least a portion of a body of a user in a seated position on the bench with the user's feet on the movable foot pedals;

(c) performing, by the user, the target exercise with the upper body of the user to engage the deltoid muscles, comprising lifting weight using the resistance load from the weight support when the user is in the seated position on the bench; and (d) while performing the target exercise of lifting weight with the deltoid muscles of the upper body, simultaneously performing a distracting exercise that engages muscles of the lower body of the user with a physical distraction to inhibit the muscles of the lower body from assisting the user's deltoid muscles of the upper body in the target exercise, the distracting exercise comprising performing the pedaling in a cycling motion with the movable foot pedals by respective feet of the user in the seated position on the bench to distract the user during the target exercise and thereby facilitate a substantially even resistive loading of weight across an axial midline of the upper body of the user.

10. The method of claim 9, wherein the target exercise and the distracting exercise are substantially biomechanically isolated from one another.

11. The method of claim 10, wherein the distracting exercise further permits the user to increase a loading of deltoid major muscles in performing the weight lifting exercise.

12. The method of claim 9, wherein the distracting exercise further permits the user to increase a loading of deltoid muscles in performing the weight lifting exercise.

13. The method of claim 9, wherein providing the physical exercise apparatus includes providing the resistance load being one of: a barbell, a dumbbell, and a kettlebell.

14. The method of claim 1, wherein the first portion of the frame configured to support the resistance load and comprising the weight support is configured to hold thereon the resistance load when the resistance load is not in use.

15. The method of claim 1, wherein the target exercise and the distracting exercise are substantially biomechanically isolated from one another.

16. The method of claim 7, wherein the first portion of the frame configured to support the resistance load and comprising the weight support is configured to hold thereon the resistance load when the resistance load is not in use.

17. The method of claim 7, wherein the target exercise and the distracting exercise are substantially biomechanically isolated from one another.

18. The method of claim 16, wherein providing the physical exercise apparatus includes providing the resistance load comprising a barbell, and wherein the first portion of the frame is configured to hold the barbell when not in use such that the barbell is within reach of the user lying on the bench to grasp the barbell for performing the target exercise while simultaneously performing the distracting exercise.

* * * * *